United States Patent [19]

Yanagida et al.

[11] 4,021,315

[45] May 3, 1977

[54] PROCESS FOR ELECTROLYTIC COLORING OF THE ANODIC OXIDE FILM ON ALUMINUM OR ALUMINUM BASE ALLOYS

[75] Inventors: Kiyomi Yanagida; Tadashi Hirokane; Tadashi Tsukiyasu; Tomoari Sato, all of Nagoya, Japan

[73] Assignee: Sumitomo Chemical Company, Limited, Osaka, Japan

[22] Filed: Aug. 27, 1975

[21] Appl. No.: 608,307

[30] Foreign Application Priority Data

Aug. 29, 1974 Japan ..... 49-99682

[52] U.S. Cl. ..... 204/35 N; 204/58

[51] Int. Cl.[2] ..... C25D 11/06; C25D 11/08

[58] Field of Search ..... 204/58, 35 N

[56] References Cited

UNITED STATES PATENTS 3,878,056 4/1975 Yanagida et al. ..... 204/58

3,892,636 7/1975 Kaneda et al. ..... 204/58

3,929,612 12/1975 Yanagida et al. ..... 204/35 N

*Primary Examiner*—R. L. Andrews

*Attorney, Agent, or Firm*—Sughrue, Rothwell, Mion, Zinn & Macpeak

[57] ABSTRACT

In the process of coloring an anodized aluminum or aluminum alloy article by subjecting the anodized article to an electrolytic treatment with a direct current in an aqueous electrolytic coloring bath containing a water-soluble metallic salt, the oxide film on the article can be easily colored in a stable manner and in a uniform color, by subjecting the anodized article previously to an anodic direct current electrolysis in an aqueous solution containing the same metallic ion as in the coloring bath, and then to a cathodic direct current electrolysis for coloring the anodized oxide film on the article.

13 Claims, No Drawings

PROCESS FOR ELECTROLYTIC COLORING OF THE ANODIC OXIDE FILM ON ALUMINUM OR ALUMINUM BASE ALLOYS

BACKGROUND OF THE INVENTION

1. Field of the Invention

The present invention relates to a process for electrolytically coloring previously anodized aluminum or aluminum base alloy (referred to simply as aluminum hereinafter) by subjecting the aluminum to a direct current electrolysis, with the aluminum as a cathode, in an electrolytic coloring bath containing a metallic salt.

2. Description of the Prior Art

One known process for electrolytically coloring aluminum is an anodic oxidation of aluminum in an aqueous solution containing an organic acid as disclosed in, for example, U.S. Pat. Nos. 3,031,387 and 3,486,991. Another process is an inorganic coloring process which comprises electrolyzing previously anodized alumimum in an electrolytic coloring bath containing a metallic salt. The latter process can be classified as an alternating current electrolysis (as disclosed in U.S. Pat. No. 3,382,160) and a direct current electrolysis (as disclosed in U.S. Pat. No. 3,761,362), depending upon the kind of electric current which is passed through the electrolytic coloring bath.

The process disclosed in U.S. Pat. No. 3,761,362 can be characterized as the coloration of previously anodized aluminum by subjecting the aluminum to a direct current electrolysis, with the aluminum as a cathode, in an electrolytic coloring bath containing a metallic salt.

In this direct current electrolysis, aqueous solutions containing a water-soluble metallic salt are used as the electrolytic coloring bath. The colors formed on the surface of the aluminum are bronze when nickel salts are used, reddish brown when copper salts are used, bronze to black when tin salts are used, bronze when cobalt salts are used and yellow when iron salts are used. However, in practicing this process on an industrial scale, contamination of the electrolytic coloring bath with impurities or variation of the pH of the bath gives rise to an unstable coloring process, and in some cases a spalling of the film results. This sometimes renders it difficult to obtain a consistently uniform, colored oxide film. Additionally, the metal element is sometimes deposited on the anodic oxide film disturbing the normal progress of the coloring.

Investigations were made on these phenomena and the following facts were discovered. When the coloring process is carried out using an electrolytic coloring bath containing, for example, water-soluble nickel salts, the colored oxide films obtained becomes paler in color as the concentration of sodium ion, which is introduced into the bath as an impurity, increases. The colored oxide film is finally spalled and thus further treatment becomes impossible. When tin salts are used, metallic tin is easily deposited on the oxide film. This phenomenon is particularly marked when the oxide film is uneven and is defective, with the result that a uniform, colored oxide film is not obtained.

SUMMARY OF THE INVENTION

An object of the present invention is, therefore, to provide an improved process for electrolytically coloring anodized aluminum which can provide a uniformly and stably colored oxide film on the aluminum without the above-described difficulty induced from the contamination of the electrolytic coloring bath and the variation in the pH.

Another object of the invention is to prevent the spalling of the oxide film and the deposition of a metal element on the oxide film, during the electrolytic coloring of the anodized aluminum.

Still another object of the invention is to provide an improved electrolytic coloring process for an anodized aluminum employing an electrolytic coloring bath which does not require the repeated purification of the bath to remove contamination and frequent reconstitution of the bath.

A further object of the invention is to improve the process for coloring an anodized aluminum using a direct current electrolysis in an electrolytic coloring bath containing a metallic salt so that the anodized aluminum can be uniformly colored in a stable manner unaccompanied by the above-described difficulty of the prior art.

As the result of various investigations, it has been found that the above objects of the present invention can be attained by the following process.

That is, the present invention provides an improved process for electrolytically coloring an anodic oxide film on aluminum by subjecting the aluminum to a direct current electrolysis, with the aluminum as a cathode, in an electrolytic coloring bath containing a metallic salt which comprises subjecting the aluminum to a direct current electrolysis, with the aluminum as an anode, in an electrolysis bath containing the same metallic ion as contained in the electrolytic coloring bath (referred to as anodic electrolysis hereinafter), and then subjecting the aluminum to a direct current electrolysis, with the aluminum as a cathode, in an electrolytic coloring bath containing the metallic salt (referred to as cathodic electrolysis hereinafter).

Further, in a preferred embodiment of this invention the anodic electrolysis and the cathodic electrolysis each is repeated alternately at least twice to obtain an even more deeply colored anodic oxide film on the aluminum.

DETAILED DESCRIPTION OF THE INVENTION

The present invention will be illustrated in greater detail hereinafter.

An object of the anodic oxidation treatment is to form a practical anodic oxide film on the surface of aluminum. Particularly, when a treatment is carried out using an anodic oxidation bath containing sulfuric acid and/or an aromatic sulfonic acid as a main component, the anodic oxide film formed on the aluminum can be colored uniformly to produce a colored oxide film which is very resistant to corrosion and weathering.

Usually, an aqueous sulfuric acid solution having a concentration of from about 5 to 30% by weight, preferably 10 to 20% by weight, is used as the anodic oxidation bath and the anodic oxidation bath can further contain a small amount of an organic acid such as oxalic acid, etc., or a salt of such an organic acid. In this case, the anodizing treatment is preferably conducted with direct current at room temperature (e.g., about 20° to 30° C) and a current density of about 1 A/dm$^2$ or, occasionally at a high current density of about 3.0 to 5.0 A/dm$^2$. However, the above-described values of the sulfuric acid concentration, the current density, and the bath temperature can be changed to some extent and effective coloring can still be achieved.

On the other hand, in using an anodic oxidation bath containing an aromatic sulfonic acid such as sulfosalicyclic acid or sulfophthalic acid as a main component, the anodic oxidation is carried out easily in a 5 to 15% by weight aqueous solution of the acid using an alternating current superimposed on a direct current.

According to the conventional direct current electrolytic coloring process, the aluminum thus anodized can be colored, without a sealing treatment, by subjecting the anodized aluminum to a direct current electrolysis, with the aluminum as a cathode, in an electrolytic coloring bath containing metallic salts.

However, the conventional process does not often produce a consistently uniform, colored oxide film for the reasons as described above. In this case, the aluminum having an anodic oxide film thereon is first subjected to the direct current electrolysis according to the present invention, with the aluminum as an anode, and then colored by subjecting the aluminum to a direct current electrolysis, with the aluminum as a cathode, in an electrolytic coloring bath.

In general, it is easy, in terms of equipment and operation, to carry out the anodic electrolysis in the electrolytic coloring bath, but the treatment can also be carried out in an anodic electrolysis bath prepared separately from the coloring bath. In the latter case, it is not always necessary for the anodic electrolysis bath to have the same composition as that of the coloring bath, but it is necessary for the anodic electrolysis bath to contain the same metallic ion, preferably the same metallic salt as contained in the coloring bath.

The current density employed in the anodic electrolysis is not particularly limited, but a range of about 0.01 to 1.0 A/dm$^2$ is preferred. The electrolysis is sufficiently completed within about 3 minutes, with a relatively long period of time being required when a small current density is used, and a relatively short period of time being required when a large current density is used.

The temperature of the bath can range from about 10° to 40° C, but room temperature (e.g., about 20° to 30° C) is preferred. These conditions should be selected depending upon the color of the anodic oxide film desired and the composition of the bath. Electrolysis conditions other than those described above can of course be used effectively for the anodic electrolysis treatment, but difficulties in the operation and economical disadvantages sometimes occur when such are used.

The aluminum which was so treated by the anodic electrolysis but was not colored at all, is then colored by subjecting the aluminum to the direct current electrolysis, with the aluminum as a cathode, in the electrolytic coloring bath.

The main component of the electrolytic coloring bath used herein is one or more water-soluble metallic salts such as water-soluble nickel salts (such as nickel sulfate, nickel chloride, nickel acetate and the like), copper salts (such as cupric sulfate and the like), tin salts (such as stannous chloride, stannous sulfate and the like), cobalt salts (such as cobalt sulfate, cobalt acetate and the like), iron salts (such as ferrous sulfate and the like) and the like. Further, a suitable amount of boric acid or sulfuric acid can be added to the bath in order to control the pH value and the electric conductivity of the bath. For example, when the main component is nickel sulfate, boric acid is often used in combination with nickel sulfate, and both components are used over a relatively wide range of concentrations, for example, about 15 to 100 g/l of nickel sulfate and about 10 to 50 g/l of boric acid, producing a superior colored oxide film. Concentrations other than those described above can, of course, be used to achieve good coloring results, but difficulties in the electrolysis operation or economical disadvantages on industrial scale equipment are encountered with their use.

The current density used in the electrolytic coloring process can range from about 0.05 to 3.0 A/dm$^2$, but a range of 0.1 to 2.0 A/dm$^2$ is preferred from an operational point of view. Further, bath temperatures in the vicinity of room temperatures are sufficient but a range from about 10° to 40° C can also be used for the coloring. As for the electrolysis time for coloring, a period of time more than about 5 minutes is not required in general, but in using a coloring bath containing a tin salt a period of time up to 15 minutes is usually employed.

The coloring treatment is completed at that point at which the aluminum is colored by the cathodic electrolysis to the desired color. When a deeper color is desired, the desired color can be obtained by repeating the anodic electrolysis and the cathodic electrolysis alternately, each more than once. That is, the coloring does not occur during the anodic electrolysis, but the color of the anodic oxide film becomes deeper as the number of the cathodic electrolyses increases. In this case, preferably there is substantially no difference in the compositions of the anodic electrolysis bath and the cathodic electrolysis coloring bath between the first electrolysis and the second electrolysis and thereafter. A slight difference in the bath composition is acceptable. Further, the electrolysis conditions of the anodic electrolysis and cathodic electrolytic coloring each may be the same or different, between the first electrolysis and the second electrolysis and thereafter, and as a matter of course operational conditions within the above-described range are desirable operationally.

The aluminum thus colored is then washed with water and then can be subjected to a conventional sealing treatment and various coating methods including electrodeposition, dipping and spraying.

The present invention can be applied particularly effectively when the conventional direct current electrolytic coloring processes fails to produce a stable and uniform, colored oxide film due to the presence of impurities in the electrolytic coloring bath which cause spalling of the film.

The effect of the present invention is also remarkable when the conventional direct current electrolytic coloring process causes a metal element to be deposited on the oxide film during the coloring, thus making it impossible to obtain normal coloring. For example, when tin salts are used in the coloring bath, a stable and black oxide film can be formed according to the present invention.

Furthermore, another unexpected effect of the present invention was discovered. That is, using the conventional coloring processes, it is difficult to color aluminum having a very thin oxide film, for example, a thin oxide film of 2 to 3 microns, and even if the aluminum is colored, the color obtained is quite uneven. However, according to the present invention, even such a thin oxide film can be colored very uniformly and easily. This effect of the present invention is exhibited particularly markedly when the present method is applied to a continuous coloring process wherein a strip or wire of aluminum is continuously colored by passing the strip or wire through the anodic oxidation system and then through the electrolytic coloring system. Therefore, the effects of the present invention are very important economically.

The term "direct current" referred to herein means an electric current which always flows in a fixed direction, as is well known. Therefore, the direct current is not limited by the wave form and it also covers all electric currents which have a wave form changing the current strength periodically, so long as the direction of the current flow is not changed.

The present invention will be illustrated with reference to the following examples. However, the present invention is not to be construed as being limited to these examples. Unless otherwise indicated, all parts, percents, ratios and the like are by weight.

EXAMPLE 1

An aluminum plate (99.2% Al) was immersed in a 10% aqueous sodium hydroxide solution at 60° C for 2 minutes and then subjected to a neutralization treatment for 4 minutes at room temperature using a 20% aqueous nitric acid solution. After rinsing the aluminum sample with water, the aluminum was anodized with a direct current using a 15% aqueous sulfuric acid solution as an anodic oxidation bath for 15 minutes at a current density of 2.0 A/dm$^2$ and at a bath temperature of 20° C. Thus, an anodic oxide film of a thickness of about 9∞ was formed on the surface of the aluminum. Three samples, Samples 1, 2 and 3, were prepared in this manner.

After rinsing these samples with water, Sample 1 was placed as a cathode in an aqueous electrolytic coloring bath containing 50 g/l of nickel sulfate, 30 g/l of boric acid and 30 ppm of sodium ion, and was electrolyzed by passing a direct current using a nickel plate as an anode for 1 minute at a current density of 0.2 A/dm$^2$ and at a bath temperature of 20° C.

Sample 2 was placed as an anode in an electrolytic coloring bath having the same composition as above and was electrolyzed by passing a direct current using a nickel plate as a cathode for 20 seconds at a current density of 0.1 A/dm$^2$ and at a bath temperature of 20° C. Thereafter, Sample 2 was subjected to a direct current electrolysis, with Sample 2 as a cathode, under the same conditions as for Sample 1.

Sample 3 was subjected to the same anodic electrolysis and cathodic electrolytic coloring as for Sample 2, in the same electrolytic coloring bath, each of the electrolyses being repeated alternately three times.

The lightness Y (%) of the samples thus treated was measured as an evaluation of the color depth. The results obtained are shown in Table 1.

Table 1

| Sample No. | Lightness Y (%) |
|---|---|
| 1 | Film Spalled |
| 2 | 2.18 |
| 3 | 1.27 |

The following conclusions can be drawn from these results. In the case of the treatment of Sample 1, wherein the anodic electrolysis was not applied prior to the cathodic electrolytic coloring process in the coloring bath containing 30 ppm of sodium ion, spalling of the oxide film resulted and a stable and uniform oxide film could not be obtained. However, in the case of Sample 2, wherein the anodic electrolysis was carried out prior to the cathodic electrolytic coloring process, a stable and uniform, colored oxide film could be obtained. Further, the stable and uniform oxide film became deeper in color by repeating both electrolytic processes alternately as in the case of Sample 3.

EXAMPLE 2

An aluminum plate (99.2% Al) was subjected to the same pretreatment and anodic oxidation as described in Example 1. Two samples, Samples 4 and 5, were prepared in this manner.

After rinsing these samples with water, Sample 4 was placed as a cathode in an aqueous electrolytic coloring bath containing 50 g/l of nickel sulfate, 35 g/l of boric acid and 40 ppm of sodium ion, and was electrolyzed by passing a direct current using a nickel plate as an anode for 1 minute at a current density of 0.2 A/dm$^2$ and at a bath temperature of 20° C.

Sample 5 was placed as an anode in the same aqueous electrolytic coloring bath as described above to which 2 g/l of sulfuric acid had further been added, and was electrolyzed by passing a direct current using a nickel plate as a cathode for 3 minutes at a current density of 0.08 A/dm$^2$ and at a bath temperature of 20° C. Thereafter, Sample 5 was subjected to a direct current electrolysis under the same conditions as for Sample 4.

As a result of the above, spalling of the oxide film was observed with Sample 4, but a uniform and stable, amber colored oxide film was obtained with Sample 5. Further, it was found that, even if the composition of the anodic electrolysis bath which is different from the composition of the electrolytic coloring bath, the effect of anodic electrolysis can be obtained sufficiently.

EXAMPLE 3

An aluminum plate (99.2% Al) was pretreated in the same manner as described in Example 1, and then was electrolyzed by passing a direct current using a 15 % aqueous sulfuric acid solution as an anodic oxidation bath for 50 minutes at a current density of 1.0 A/dm$^2$ and at a bath temperature of 20° C. Thus, an anodic oxide film having a thickness of about 15 microns was formed. Two samples, Samples 6 and 7, were prepared in this manner.

After rinsing these samples with water, Sample 6 was placed as a cathode in an aqueous electrolytic coloring bath containing 30 g/l of stannous sulfate, and was electrolyzed by passing a direct current using a tin plate as an anode for 10 minutes at a current density of 0.3 A/dm$^2$ and at a bath temperature of 20° C.

Sample 7 was placed as an anode in an aqueous electrolytic coloring bath having the same composition as above and was electrolyzed by passing a direct current using a tin plate as a cathode for 20 seconds at a current density of 0.1 A/dm$^2$ and at a bath temperature of 20° C. Thereafter, Sample 7 was subjected to a direct current electrolysis with Sample 7 as a cathode under the same conditions as for Sample 6.

As a result of the above procedures, a deep black oxide film was not produced on Sample 6 due to deposition of metallic tin on the surface thereof, but a deep black oxide film without deposition of metallic tin was obtained with Sample 7. Therefore, it can be seen that the method of the present invention is very effective for formation of a black oxide film with an electrolytic coloring bath containing tin salts.

EXAMPLE 4

A continuous electrolytic coloring process, wherein an aluminum strip (99.2 % Al, 55 mm in width and 0.3 mm in thickness) was passed, at a rate of 12 cm/min, through continuous electrolytic coloring equipment comprising a current-supplying bath which also served as an electrolytic degreasing bath, an anodic oxidation bath containing sulfuric acid, a rinsing bath, an anodic electrolysis bath, an electrolytic coloring bath, a rinsing bath and a sealing bath, was employed and a colored oxide film was formed on the surface of the aluminum strip. The following operations were carried out in each bath:

1. Electrolytic Degreasing Bath

The aluminum strip was electrolytically degreased by electrolyzing using a direct current in a 30% aqueous sulfuric acid solution as an electrolytic degreasing bath for 4 minutes, with the aluminum as a cathode, at a current density of 1.5 A/dm$^2$ and at a bath temperature of 25° C.

2. Anodic Oxidation Bath

The degreased aluminum was electrolyzed using a direct current in a 30 % aqueous sulfuric acid solution as an anodic oxidation bath for 7 minutes, with the aluminum as an anode, at a current density of 1.5 A/dm$^2$ and at a bath temperature of 25° C, whereby an anodic oxide film of a thickness of about 4 microns was formed.

3. Rinsing Bath

The anodized aluminum was passed through the rinsing bath containing fresh water.

4. Anodic Electrolysis Bath

The rinsed aluminum was subjected to an anodic electrolysis by passing a direct current in an aqueous solution containing 50 g/l of nickel sulfate and 30 g/l of boric acid as an anodic electrolysis bath for 40 seconds, with the aluminum as an anode and a nickel plate as a cathode, at a current density of 0.2 A/dm$^2$ and at a bath temperature of 25° C.

5. Electrolytic Coloring Bath

The treated aluminum was electrolytically colored in an electrolytic coloring bath having the same composition as that of the anodic electrolysis bath, by passing a direct current, with the aluminum as a cathode and a nickel plate as an anode, for 15 seconds at a current density of 0.7 A dm$^2$ and at a bath temperature of 25° C.

6. Rinsing Bath

The colored aluminum was passed through the rinsing bath containing fresh water.

7. Sealing Bath

The rinsed aluminum was subjected to a sealing treatment in boiling water in the sealing bath.

The aluminum sample thus obtained had a uniform and stable, colored oxide film with no unevenness in color.

When the coloring procedures were carried out in the same manner as described in Example 4, except that the anodic electrolysis prior to the electrolytic coloring was not carried out, the aluminum obtained had an unstable, colored oxide film with an unevenness in color such as stripped patterns on the surface thereof.

While the invention has been described in detail and with reference to specific embodiments thereof, it will be apparent to one skilled in the art that various changes and modifications can be made therein without departing from the spirit and scope thereof.

What is claimed is:

1. In a process for electrolytically coloring an anodic oxide film on an aluminum or aluminum alloy article by (1) subjecting said article to anodic oxidation in an aqueous anodic oxidation bath consisting essentially of sulfuric acid or an aromatic sulfonic acid to form an anodic oxide film; and (2) subjecting said anodic oxidized article to cathodic electrolytic coloring using a direct current in an aqueous, electrolytic coloring bath containing a water-soluble metallic salt; the improvement which comprises subjecting said anodic oxidized article to anodic electrolysis using a direct current in an aqueous anodic electrolysis bath containing the same metal ion as in the coloring bath but having no ability to form an oxide film on said article, after step (1) above but prior to said electrolytic coloring step (2) above.

2. The process according to claim 1, wherein the current density in said cathodic electrolytic coloring is about 0.05 to 3.0 A/dm$^2$.

3. The process according to claim 2, wherein the current density is 0.1 to 2.0 A/dm$^2$.

4. The process according to claim 1, wherein said anodic electrolysis is carried out in the same bath as the cathodic electrolytic coloring bath.

5. The process according to claim 1, wherein the current density in the anodic electrolysis is about 0.01 to 1.0 A/dm$^2$.

6. The process according to claim 1, wherein the electrolysis time in the anodic electrolysis is up to about 3 minutes.

7. The process according to claim 1, wherein the temperature in the anodic electrolysis is about 10° to 40° C.

8. The process according to claim 1, wherein the water-soluble metallic salt is a water-soluble nickel salt, a water-soluble copper salt, a water-soluble tin salt, a water-soluble cobalt salt or a water-soluble iron salt.

9. The process according to claim 1, wherein the temperature in said cathodic electrolytic coloring is 10° to 40° C.

10. The process according to claim 1, wherein said anodic electrolysis and said cathodic electrolytic coloring are repeated alternately, each at least once, in an aqueous electrolytic coloring bath containing 15 to 100 g/l of nickel sulfate and 10 to 50 g/l of boric acid.

11. The process according to claim 1, wherein said aqueous electrolytic coloring bath further contains boric acid and said aqueous anodic electrolysis bath further contains boric acid.

12. The process for electrolytically coloring an anodic oxide film on an aluminum or aluminum alloy article by (1) subjecting said article to anodic oxidation in an aqueous oxidation bath consisting essentially of sulfuric acid or an aromatic sulfonic acid to form an anodic oxide film; and (2) subjecting said anodic oxidized article to cathodic electrolytic coloring used a direct current in an aqueous electrolytic coloring bath containing a water-soluble metallic salt; the improvement which comprises subjecting said anodic oxidized article to anodic electrolysis using a direct current in an aqueous anodic electrolysis bath containing the same metallic ion as in the coloring bath but having no ability to form an oxide film on said article, after step (1) above but prior to said electrolytic coloring step (2) above, and repeating said anodic electrolysis and said cathodic electrolytic coloring alternately at least twice in the order recited.

13. The process according to claim 12, wherein said aqueous electrolytic coloring bath further contains boric acid and said aqueous anodic electrolysis bath further contains boric acid.

* * * * *